US007896487B2

(12) United States Patent
Sugahara

(10) Patent No.: US 7,896,487 B2
(45) Date of Patent: Mar. 1, 2011

(54) PRINTER AND TRANSFERRING BODY

(75) Inventor: Hiroto Sugahara, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 1078 days.

(21) Appl. No.: 11/654,849

(22) Filed: Jan. 18, 2007

(65) Prior Publication Data

US 2007/0165052 A1 Jul. 19, 2007

(30) Foreign Application Priority Data

Jan. 19, 2006 (JP) ..... 2006-010598

(51) Int. Cl.
*B41J 2/01* (2006.01)

(52) U.S. Cl. ..... 347/103; 347/55; 347/88

(58) Field of Classification Search ..... 347/101, 347/103, 88, 99, 55, 5
See application file for complete search history.

(56) References Cited

U.S. PATENT DOCUMENTS 5,539,440 A * 7/1996 Higuchi et al. ..... 347/112
6,545,815 B2 4/2003 Kroupenkine et al.
6,557,979 B2 * 5/2003 Ohsawa et al. ..... 347/55
7,708,384 B2 * 5/2010 Sugahara ..... 347/55
2007/0024669 A1 * 2/2007 Sugahara ..... 347/45

FOREIGN PATENT DOCUMENTS

JP 2003-177219 6/2003
JP 2004042454 2/2004
JP 2004291275 10/2004

* cited by examiner

*Primary Examiner*—Manish S Shah
(74) *Attorney, Agent, or Firm*—Frommer Lawrence & Haug LLP

(57) ABSTRACT

On a transferring surface of a transferring body, lyophilic areas arranged in a scanning direction and in a circumferential direction of the transferring body, and a liquid repellent area which surrounds the lyophilic areas are formed. In a circumferential area between one of the lyophilic areas and the liquid repellent area, a proportion of the liquid repellent area increases progressively at positions away from a center of the lyophilic area. An ink droplet which is jetted from a nozzle, and is adhered to the circumferential area moves toward the center of the lyophilic area till a center of the liquid droplet coincides with the center of the lyophilic area. Therefore, it is possible to prevent a position shift in a final adhering position.

20 Claims, 13 Drawing Sheets

PRINTER AND TRANSFERRING BODY

CROSS REFERENCE TO RELATED APPLICATION

The present application claims priority from Japanese Patent Application No. 2006-010598, filed on Jan. 19, 2006, the disclosure of which is incorporated herein by reference in its entirety.

BACKGROUND OF THE INVENTION

1. Field of the Invention

The present invention relates to a printer which performs printing by transporting a liquid to a recording medium such as a recording paper, and a transferring body which transfers a liquid droplet of the liquid to the recording medium.

2. Description of the Related Art

Among printers which perform printing on a recording medium such as a recording paper by discharging an ink droplet from a nozzle, there is a printer in which the ink droplet from the nozzle is adhered to a transferring body once, and then the ink droplet adhered to the transferring body is transferred to a recording medium. For example, in an image recording apparatus (printer) described in Japanese Patent Application Laid-open No. 2004-291275, a plurality of lyophilic ink-philic parts (lyophilic areas), having a wettability (having low liquid repellent property) for ink, on a surface of a transferring drum (transferring body) to which the ink is adhered, are arranged in the form of a lattice, and an ink-phobic part (liquid repellent area) which does not have wettability for the ink (having high liquid repellent property) is formed in an area other than the area in which the ink-philic parts are formed. Accordingly, even when a position of landing (landing position) of the ink which is discharged from the nozzle is deviated from a desired position on the surface of the transferring drum, the ink is landed at an appropriate position on the surface of the transferring drum since the ink adhered to the ink-phobic part moves to the ink-philic part.

However, in the image recording apparatus described in Japanese Patent Application Laid-open No. 2004-291275, when an ink droplet larger than the ink-phobic part is adhered, there is a possibility that there is a position shift of an adhering position of a portion of the ink droplet which protrudes from (sticks out of) the ink-philic part. On the other hand, when an ink droplet smaller than the ink-philic part is adhered, there is a possibility that there is a position shift of an adhering position of the ink droplet within the ink-philic part. Due to such a position shift of the adhering position of the ink droplet, there is a possibility that in a case of performing a liquid droplet gradation in which the printing is performed by discharging ink droplets of a plurality of types of inks having mutually different volumes, the printing quality is declined.

SUMMARY OF THE INVENTION

An object of the present invention is to provide a printer and a transferring body in which a position shift of a final adhering position of a liquid droplet on the transferring body hardly occurs. A reference numeral in bracket assigned to each component shown below is only for exemplifying that component, and does not restrict the component.

According to a first aspect of the present invention there is provided a printer (1) which performs printing on a recording medium (P) by discharging liquid droplets, including a liquid droplet discharging section (2) which has a plurality of discharge ports (15), and a transferring body (3) which transfers, to the recording medium (P), liquid droplets discharged from the discharging ports (15), and which has on a surface (3*a*) thereof a plurality of lyophilic areas (50), a plurality of circumferential areas (53) surrounding the lyophilic areas (50), and a liquid repellent area (51) surrounding the circumferential areas (53). A liquid repellent property on the circumferential areas (53) is progressively increased at positions away from a center of the lyophilic area (50).

In this case, when an adhering position on the transferring body (3), of the liquid droplet discharged from the liquid droplet discharging section (2) is shifted, and when the liquid droplet is adhered to one of the circumferential areas (53), the liquid droplet moves to the lyophilic area (50) having low liquid repellent property. At this time, since a liquid repellent property of the circumferential areas (53) is increased progressively at positions away from a center of the lyophilic area (50), even when the liquid droplet is larger than the lyophilic area (50), the liquid droplet moves toward the center of the lyophilic area (50). Accordingly, the position shift in the final adhering position of the liquid droplet with respect to the transferring body (3) hardly occurs, and a printing quality is improved.

In the printer (1) of the present invention, on each of the circumferential areas (53), a proportion of an area of the liquid repellent area (51) with respect to an area of the lyophilic area (50), may increase progressively at positions away from the center of the lyophilic area (50). In this case, on each of the circumferential areas (53), it is possible to increase the liquid repellent property progressively, at positions away from the center of the lyophilic area (50).

In the printer (1) of the present invention, a boundary (52) between each of the lyophilic areas (50) and the liquid repellent area (51) may be serrated. In this case, on each of the circumferential areas (53), it is possible to increase progressively the proportion of the area of the liquid repellent area (51) at positions away from the center of the lyophilic area (50).

In the printer (1) of the present invention, in each of the circumferential areas (53), the lyophilic area (50) may form a pattern in which a plurality of projections (50*a*) projected acutely toward the liquid repellent area (51) are arranged. Even in this case, it is possible to increase progressively the proportion of the area of the liquid repellent area (51), at positions away from the center of the lyophilic area (50).

In the printer (1) of the present invention, in each of the circumferential areas (63), a plurality of island portions (62) having a liquid repellent property same as a liquid repellent property of a lyophilic area (60) may be arranged in a discrete manner in a liquid repellent area (61), and a distribution density of the island portions (62) may decrease progressively at positions away from a center of the lyophilic area (60). In this case, in each of the circumferential areas (63), it is possible to increase progressively the proportion of an area of the liquid repellent area (61) at positions away from the center of the lyophilic area (60).

In the printer (1) of the present invention, in each of circumferential areas (73), an intermediate area (72) having a liquid repellent property which is higher than a liquid repellent property of one of lyophilic areas (70), and is lower than a liquid repellent property of a liquid repellent area (71) may be provided along an entire circumference of one of the lyophilic areas (70). In this case, it is possible to improve gradually a liquid repellent property on each of the circumferential areas (73) progressively at positions away from the center of the lyophilic area (70). At this time, in each of the circumferential areas (73), the intermediate area (72) may be formed as a plurality of intermediate areas (72*a*, 72*b*) in a radial direction of one of the lyophilic areas (70), and a liquid repellent property of the intermediate areas (72*a*, 72*b*) may be increase progressively at positions away from the center of one of the lyophilic areas (70). In this case, it is possible to make a change in the liquid repellent property of each of the circumferential areas (73) gradually, and the liquid droplet adhered to one of the circumferential areas (73) tends to move easily toward the center of the lyophilic area (70).

In the printer (1) of the present invention, the liquid droplet discharging section (2) may discharge liquid droplets of different volumes. In this case, since in each of the circumferential areas (53), the liquid repellent property is increased progressively at positions away from the center of the lyophilic area (50), even when the liquid droplets of mutually different volumes are discharged, the liquid droplets move toward the center of the lyophilic area (50). Consequently, even when the liquid droplet gradation is performed, the position shift of the final landing position of the liquid droplet on the transferring body (3) hardly occurs, and the printing quality is improved.

In the printer (1) of the present invention, in the liquid droplet discharging section (2), the discharge ports (15) may be arranged in a predetermined direction, and in the transferring body (3), the lyophilic areas (50) may be arranged in the predetermined direction, and a spacing distance (P1) between the discharge ports (15) in the predetermined direction may be same as a spacing distance (P1) between the lyophilic areas (50) in the predetermined direction. In this case, since the liquid droplet is discharged from each of the discharge ports (15) to one of the corresponding lyophilic areas (50), the printing is performed assuredly.

In the printer (1) of the present invention, the transferring body (3) may have a substantially circular cylindrical shape, and may be rotatably attached to the printer (1) about a predetermined axis as a center, and the lyophilic areas (50) and the liquid repellent area (51) may be formed on a side surface (3*a*) of the transferring body (3), and the transferring body (3) may rotate about the predetermined axis as the center to discharge the ink droplets from the discharge ports (15) when each of the lyophilic areas (50) reaches a position facing one of the discharge ports (15). In this case, since the liquid droplet is discharged in a state in which one of the discharge ports (15) is adjacent to the one of the lyophilic areas (50), the liquid droplet is adhered assuredly to one of the lyophilic areas (50).

According to a second aspect of the present invention, there is provided a transferring body (3) which transfers, to a recording medium (P), a liquid droplet discharged from a liquid droplet discharging section (2), including a first area (C3) which is formed on a surface (3*a*) of the transferring body (3), a transition area (53) which is formed on the surface (3*a*) of the transferring body (3), and which surrounds the first area (C3), and a second area (C4) which is formed on the surface (3*a*) of the transferring body (3), and which surrounds the transition area (53). A liquid repellent property on the transition area (53) is higher than a liquid repellent property of the first area (C3), and is lower than a liquid repellent property of the second area (C4).

Since the liquid repellent property of the transition area (53) is higher than the liquid repellent property of the first area (C3), and is lower than the liquid repellent property of the second area (C4), even when the liquid droplet is landed on the transition area (53), it is possible to move the liquid droplet toward a center of the first area (C3) so that the center of the liquid droplet almost coincides with a center of the first area (C3).

In the transferring body (3) of the present invention, the liquid repellent property of the transition area (53) may increase progressively at positions away from the center of the first area (C3). In this case, even when the liquid droplet is adhered to the transition area (53), the liquid droplet moves toward the center of the first area (C3) Accordingly, a position shift in the final adhering position of the liquid droplet on the transferring body (3) hardly occurs, and the printing quality is improved.

In the transferring body (3) of the present invention, in the transition area (53), a lyophilic area (50) and a liquid repellent area (52) may exist in a mixed manner. In this case, it is possible to make the liquid repellent property of the transition area (53) higher than the liquid repellent property of the first area (C3), and lower than the liquid repellent property of the second area (C4).

In the transferring body (3) of the present invention, in the transition area (53), a proportion of an area of the liquid repellent area (51) with respect to an area of the lyophilic area (50) may increase progressively at positions away from the center of the first area (C3). In this case, in the transition area (53), it is possible to increase gradually the liquid repellent property at positions away from the center of the first area (C3).

In the transferring body (3) of the present invention, in the transition area (53), a boundary (52) between the lyophilic area (50) and the liquid repellent area (51) may be formed to be serrated, and the lyophilic area (50) may be formed along a circumference of the first area (C3) as a plurality of lyophilic areas (50*a*) projecting acutely toward the second area (C4). In these cases, in the transition area (53), since the proportion of the area of the liquid repellent area (51) increases progressively at positions away from the center of the first area (C3), it is possible to increase progressively the liquid repellent property at positions away from the center of the first area (C3).

In the transferring body (3) of the present invention, in a transition area (63), lyophilic areas (62) may be arranged in a discrete manner in a liquid repellent area (61), and a distribution density of the lyophilic areas (62) may decrease progressively at positions away from the center of the first area (C3). Even in this case, in the transition area (63), since a proportion of an area of the liquid repellent area (61) increases progressively at positions away from the center of the first area (C3), it is possible to increase progressively the liquid repellent property at positions away from the center of the first area (C3).

In the transferring body (3) of the present invention, the first area (C3) may be formed of an aluminum alloy, the transition area (53) may be formed of a polyimide, and the second area (C4) may be formed of a fluororesin.

According to a third aspect of the present invention, there is provided a printer (1) which performs printing on a recording medium (P) by discharging liquid droplets, including a liquid droplet discharging section (2) which has a plurality of discharge ports (15) and the transferring body (3) as defined in the second aspect.

By using the transferring body (3) as defined in the second aspect, even when the liquid droplet is landed on the transition area (53), it is possible to move the liquid droplet toward a center of the first area (C3) so that the center of the liquid droplet almost coincides with a center of the first area (C3). Accordingly, a printer in which a position shift of a final adhering position of a liquid droplet on the transferring body (3) hardly occurs can be provided.

In the printer (1) of the present invention, in the liquid droplet discharging section (2), the discharge ports (15) may be arranged in a predetermined direction, in the transferring body (3), the first area (C3) may be formed as a plurality of first areas (C3) and the first areas (C3) may be arranged in the predetermined direction; and a spacing distance (P1) between the discharge ports (15) in the predetermined direction may be same as a spacing distance (P1) between the first areas (C3) in the predetermined direction. In this case, since the liquid droplet is discharged from each of the discharge ports (15) to one of the corresponding first areas (C3), the printing is performed assuredly.

BRIEF DESCRIPTION OF THE DRAWINGS

FIG. 8A shows a case when a small droplet is jetted from a nozzle, FIG. 8B shows a case when a medium droplet is jetted from the nozzle, and FIG. 8C shows a case when a large droplet is jetted from the nozzle;

DETAILED DESCRIPTION OF THE PREFERRED EMBODIMENTS

Figure 1:
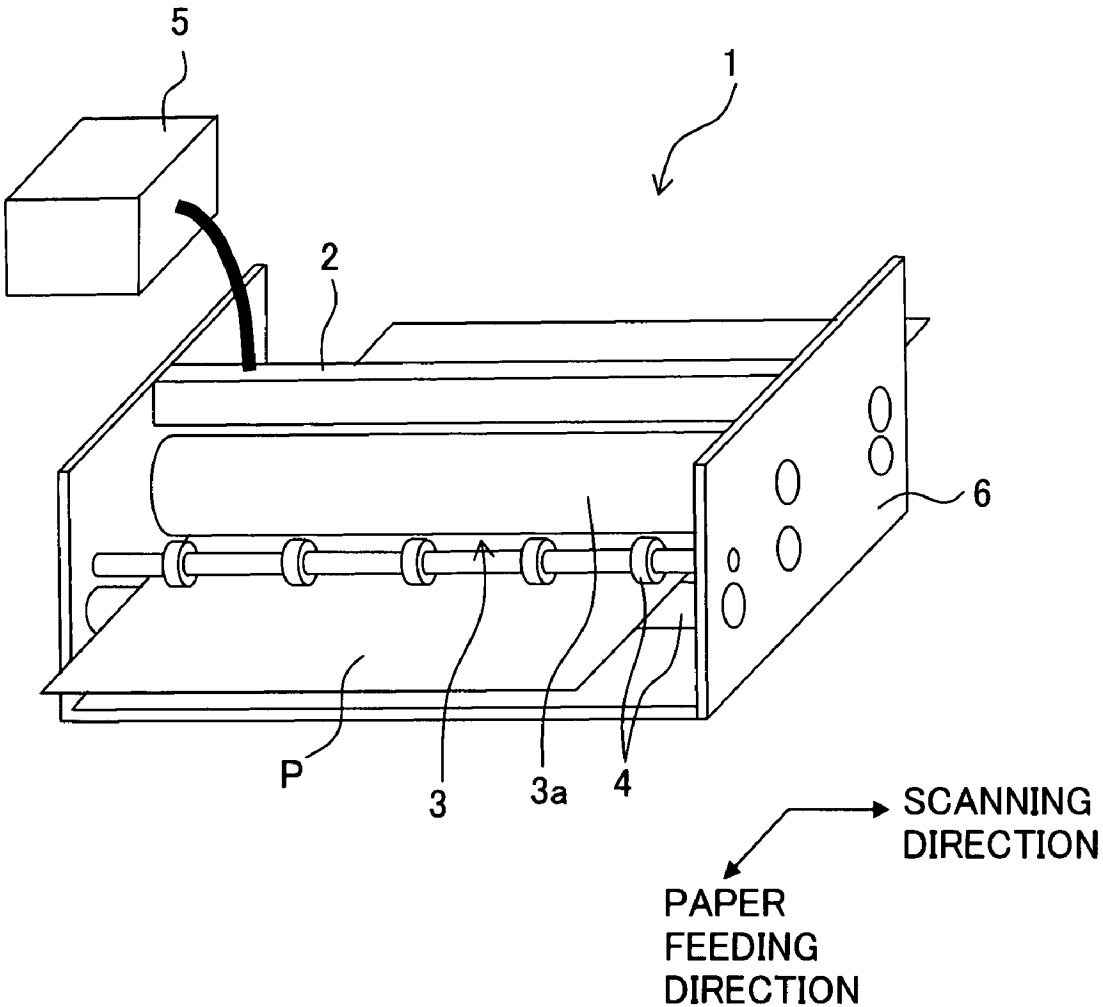
FIG. 1 is a schematic structural view of a printer according to an embodiment of the present invention.

An exemplary embodiment of the present invention will be described below while referring to the accompanying diagram. As shown in FIG. 1, a printer 1 includes an ink-jet head 2 (liquid droplet discharging section), a transferring drum 3 (transferring body), a plurality of paper transporting rollers 4, an ink tank 5, a frame 6, and the like. The ink-jet head 2, is a line head which is longer in a scanning direction (left and right direction in FIG. 1), and jets (discharges) an ink supplied from the ink tank 5, as ink droplets from a plurality of nozzles 15 (discharge ports) (refer to FIG. 2) arranged in a scanning direction (left and right direction in FIG. 1) on a lower surface of the ink-jet head 2. The ink-jet head 2 makes the ink droplets adhere to a side surface (surface) 3*a* of the transferring drum 3 which has a circular cylindrical shape. Here, the term "side surface" of the circular cylindrical shaped transferring drum 3 means a round surface, which corresponds to a rectangle when the circular cylinder is unfolded (rolled out), of the transferring drum 3. The transferring drum 3 is substantially circular cylindrical shaped having almost the same length as the ink-jet head 2 in the scanning direction, and is rotatably installed on the frame 6. Moreover, the transferring drum 3 is rotated and driven by a drive motor 8 (refer to FIG. 7), and as it will be described later, transfers ink droplets to a recording paper P (recording medium) by bringing in contact with the recording paper P, a portion of the surface 3*a* to which the ink droplets are adhered. The paper transporting rollers 4 rotate in synchronization with a rotating speed of the transferring drum 3, and transport the recording paper P in a paper feeding direction (frontward direction in FIG. 1).

Figure 2:
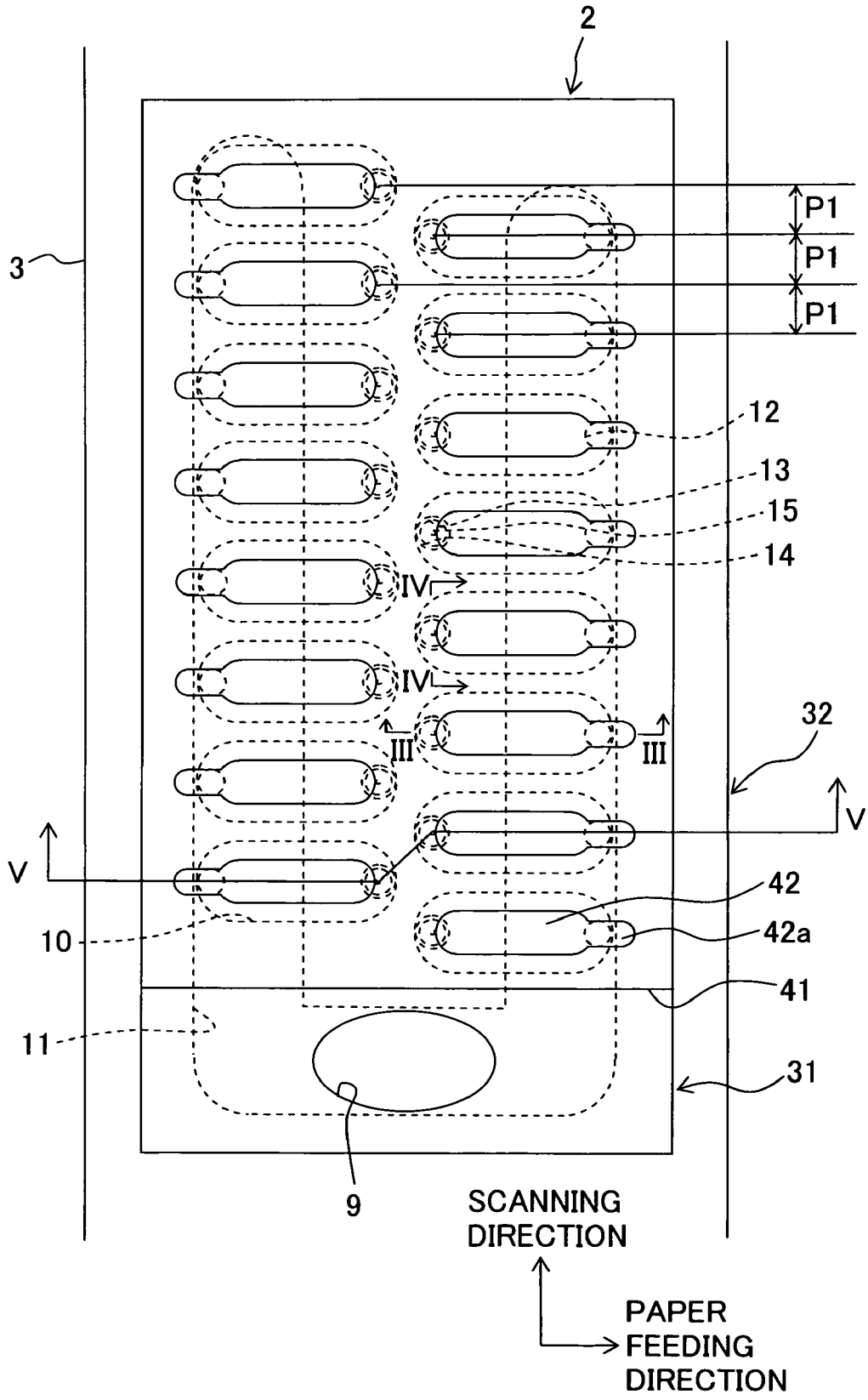
FIG. 2 is a plan view of an ink-jet head in FIG. 1.
Figure 3:
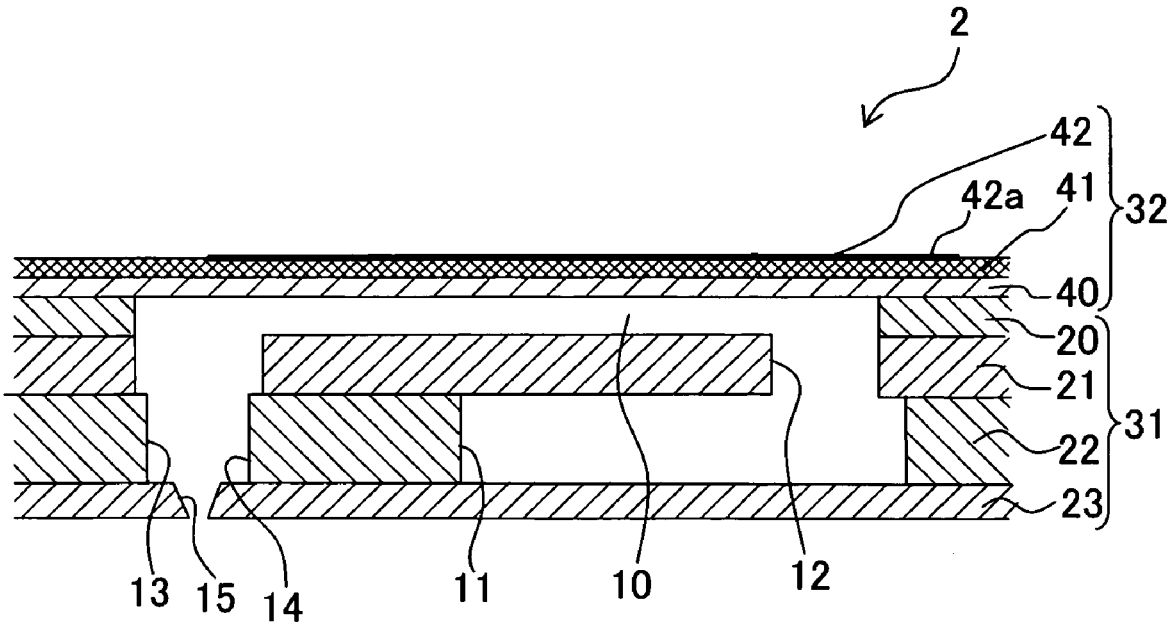
FIG. 3 is a cross-sectional view taken along a line III-III shown in FIG. 2.
Figure 4:
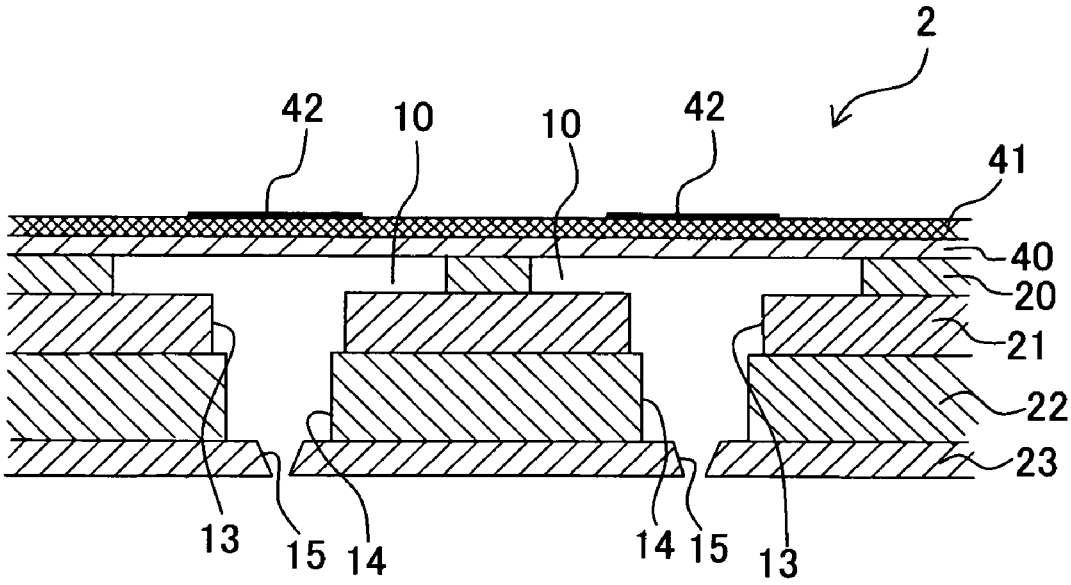
FIG. 4 is a cross-sectional view taken along a line IV-IV shown in FIG. 2.

Next, the ink-jet head 2 will be described by referring to FIG. 2 to FIG. 4. As shown in FIG. 2 to FIG. 4, the ink-jet head 2, includes a channel unit 31 in which a plurality of individual channels including pressure chambers 10 is formed, and a piezoelectric actuator 32 which is arranged on an upper surface of the channel unit 31.

The channel unit 31, as shown in FIG. 3 and FIG. 4 includes a cavity plate 20, a base plate 21, a manifold plate 22, and a nozzle plate 23, and is formed by stacking these four plates. From among the four plates 20 to 23, the three plates 20 to 22 except for the nozzle plate 23, are formed of a metallic material such as stainless steel, and the ink channels such as the pressure chambers 10 and manifold channels 11 are formed by an etching. The nozzle plate 23 is formed of a synthetic resin material such as polyimide, and is stuck to a lower surface of the manifold plate 22. Or, the nozzle plate 23, similar to the three plates 20 to 22 may also be formed of a metallic material.

The plurality of pressure chambers 10 (16 pieces in FIG. 2) which are arranged in two rows in the scanning direction (vertical direction in FIG. 2) is formed in the cavity plate 20 as shown in FIG. 2 to FIG. 5. The pressure chambers 10 are substantially elliptical shaped with a longitudinal axis of the elliptical shape in the paper feeding direction in a plan view.

A plurality of communicating holes 12 and 13 having a substantially circular shape in a plan view is formed in the base plate 21, in a portion overlapping with both ends in the longitudinal direction, of the pressure chambers 10 respectively.

A manifold channel 11 which is extended in the scanning direction is formed in the manifold plate 22. The manifold channel 11 overlaps with a substantial right half portion of the pressure chambers 10 arranged on a right side in FIG. 2 in a plan view, and also overlaps with a substantial left half portion of the pressure chambers 10 arranged on a left side in FIG. 2 in a plan view. An ink is supplied to the manifold channel 11 from an ink supply port 9 which is formed in a vibration plate 40 which will be described later. Moreover, a plurality of communicating holes 14 having a substantially circular shape in a plan view is formed at portions overlapping with the communicating holes 13 in a plan view.

A plurality of nozzles 15 is formed in the nozzle plate 23, at positions overlapping with the communicating holes 14 in a plan view. The nozzles 15 are arranged at equal intervals in two rows in the scanning direction, corresponding to the pressure chambers 10, and as shown in FIG. 2, an interval between two nozzles 15 at the nearest position with respect to the scanning direction is P1. Here, when the nozzle plate 23 is formed of a synthetic resin material, it is possible to form the nozzles 15 by a process such as an excimer laser process, and when the nozzle plate 23 is formed of a metallic material, it is possible to form the nozzles 15 by a process such as a press processing.

The manifold channel 11 communicates with the pressure chambers 10 via the communicating holes 12. Furthermore, the pressure chambers 10 communicate with the nozzles 15 via the communicating holes 13 and 14. Thus, individual ink channels from the manifold channel 11 up to the nozzles 15 via the pressure chambers 10 are formed in the channel unit 31.

Next, the piezoelectric actuator 32 will be described below. The piezoelectric actuator 32, as shown in FIG. 2 to FIG. 4, includes the vibration plate 40 which is electroconductive, and is arranged on a surface of the cavity plate 20, a piezoelectric layer 41 which is formed on an upper surface of the vibration plate 40, and a plurality of individual electrodes 42 which are formed corresponding to the pressure chambers 10, on an upper surface of the piezoelectric layer 41.

The vibration plate 40 is made of a metallic material, such as an iron alloy like stainless steel, a nickel alloy, an aluminum alloy, or a titanium alloy, and is joined to the cavity plate 20 to cover the pressure chambers 10. Moreover, the vibration plate 40 is electroconductive, and also serves as a common electrode which generates an electric field in the piezoelectric layer 41 which is sandwiched between the vibration plate 40 and the individual electrodes 42. The vibration plate 40 is kept all the time at a ground electric potential by a driver IC 45 (refer to FIG. 7).

In an area excluding an area near a lower end portion of the channel unit 31 in FIG. 2 on the upper surface of the vibration plate 40, the piezoelectric layer 41 composed of mainly lead zirconate titanate (PZT) which is a solid solution of lead titanate and lead zirconate is formed continuously spreading over the pressure chambers 10. Here, the piezoelectric layer 41 is formed by an aerosol deposition method (AD method) in which, ultra fine particles of a piezoelectric material are deposited on the upper surface of the vibration plate 40 by allowing to collide at a high speed. Apart from this, it is also possible to use a sol-gel method, a sputtering method, a hydrothermal synthesis method, and a chemical vapor deposition method (CVD method) for forming the piezoelectric layer 41. Or, it is also possible to form the piezoelectric layer 41 by sticking on the upper surface of the vibration plate 40, a piezoelectric sheet which is obtained by baking a green sheet of PZT.

The plurality of individual electrodes 42 is formed on the upper surface of the piezoelectric layer 41, corresponding to the plurality of pressure chambers 10 as shown in FIG. 2 to FIG. 4. The individual electrode 42, as shown in FIG. 2, has a substantial elliptical shape slightly smaller than the pressure chamber 10, and is positioned to overlap with a substantial central portion of the pressure chamber 10 in a plan view. Moreover, the individual electrode 42 is extended in a longitudinal direction of the pressure chamber 10 up to a portion on a side opposite to the nozzle 15, and a contact point 42*a* is formed on the portion not overlapping with the pressure chamber 10 in a plan view. Further, the individual electrode 42 is connected to the driver IC 45 (refer to FIG. 7) at the contact point 42*a*, via a flexible printed circuit (FPC) which is not shown in the diagram, and an electric potential of the plurality of individual electrodes is controlled by the driver IC 45. Here, the individual electrode 42 is made of an electroconductive material such as gold, copper, silver, palladium, and titanium, and it is possible to form the individual electrode 42 by a method such as a screen printing method and the sputtering method.

The driver IC 45 (refer to FIG. 7) keeps the vibration plate 40 serving as the common electrode, at a ground electric potential, and is capable of applying three types of predetermined electric potentials to the individual electrode 42. The driver IC 45 controls the electric potential to be applied to the individual electrode 42, and as it will be described later, controls an action of the piezoelectric actuator 32. Moreover, the driver IC 45, as it will be described later, is controlled by a control unit 46 (refer to FIG. 7), so as to apply the electric potential to the individual electrode 42 at a predetermined timing.

Next, an action of the piezoelectric actuator 32 will be described below. When a predetermined electric potential is applied to the individual electrode 42 by the driver IC 45, an electric potential difference is developed in a portion sandwiched between the individual electrode 42 to which the predetermined electric potential is applied and the vibration plate 40 which serves as the common electrode. Consequently, an electric field in direction of thickness is generated in this portion of the piezoelectric layer 41. Accordingly, when a direction in which the piezoelectric layer 41 is polarized is the direction of thickness same as the direction of the electric field, this portion of the piezoelectric layer 41 is contracted in a horizontal direction which is orthogonal to the direction of thickness. With the contraction of the piezoelectric layer 41, the vibration plate 40 is deformed to form a projection downward, and a volume of the pressure chamber 10 is decreased. Consequently, a pressure on the ink in the pressure chamber 10 is increased, and an ink droplet is jetted from the nozzle 15 which communicates with the pressure chamber 10.

Here, the driver IC 45, as it has been described earlier, is capable of applying the three types of electric potentials to the individual electrode 42, as the predetermined electric potential. Further, when the electric potential applied to the individual electrode 42 is changed, an amount of deformation of the vibration plate 40 is changed. Therefore, a volume of the ink droplet jetted from the nozzle 15 changes according to the electric potential applied to the individual electrode 42. In other words, in the ink-jet head 2, it is possible to perform a liquid-droplet gradation which jets three types of ink droplets each having different volume (hereinafter, a small droplet I1, a medium droplet I2, and a large droplet I3 in an ascending order of volume (refer to FIG. 8)) from the nozzle 15.

Figure 5:
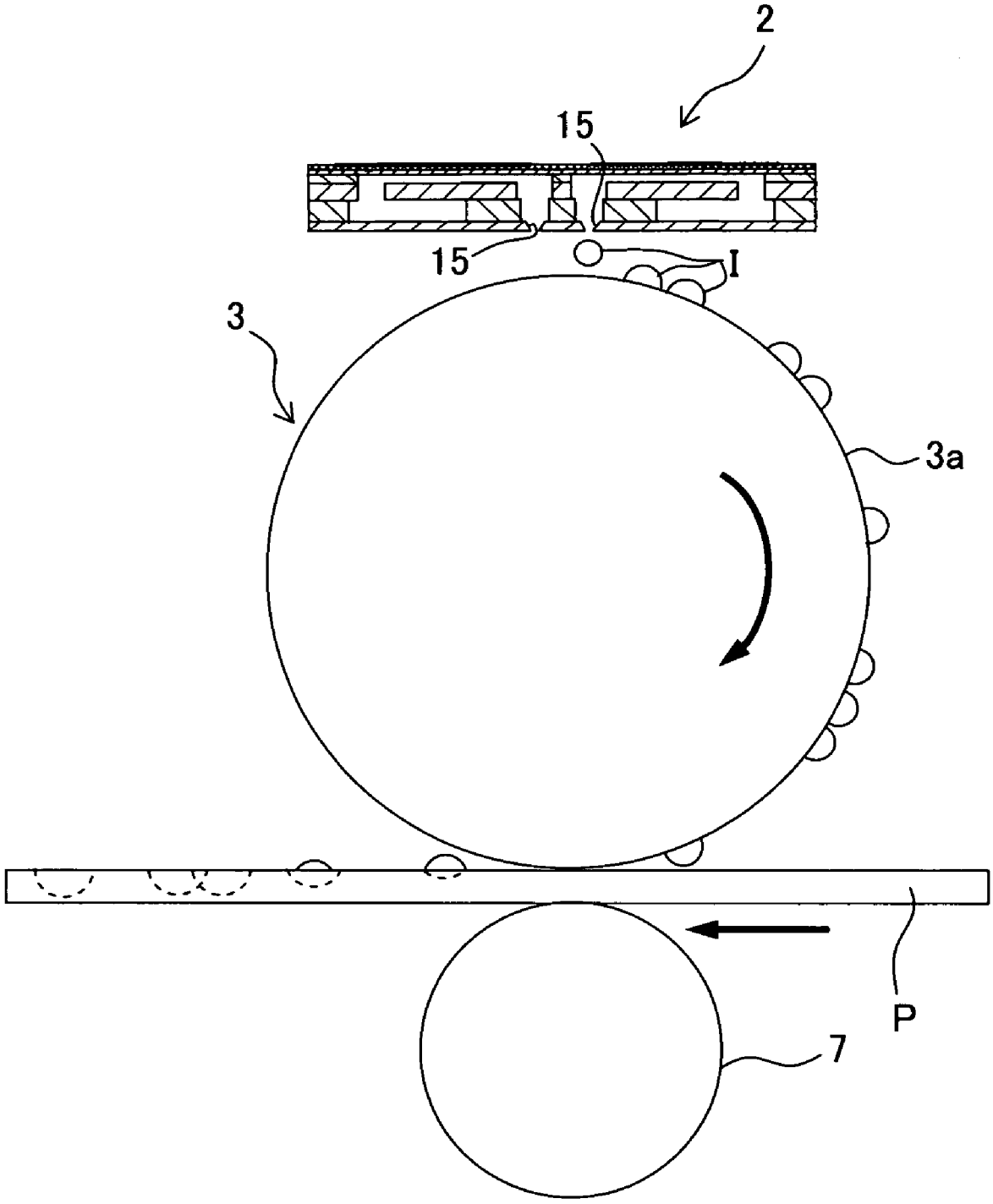
FIG. 5 is a cross-sectional view taken along a line V-V shown in FIG. 2.

Next, the transferring drum 3 will be described by referring to FIG. 5 and FIG. 6. As shown in FIG. 5, the transferring drum 3 is positioned under the ink-jet head 2, and is capable of rotating in a clockwise direction in FIG. 5. Moreover, a portion of the transferring drum 3, which is positioned at an uppermost side of the side surface 3*a*, is facing the nozzle 15. Accordingly, an ink droplet I jetted from the nozzle 15 is adhered to a portion of the side surface 3*a* facing the nozzle 15.

On the other hand, a supporting roller 7 is arranged under the transferring drum 3, and a recording paper P is pinched between the transferring drum 3 and the supporting roller 7. Further, the transferring drum 3 is rotated in the clockwise direction in FIG. 5 by the drive motor 8 (refer to FIG. 7) and the supporting roller 7 is rotated in a counterclockwise direction. Accordingly, the portion of the side surface 3*a* to which the ink droplet I is adhered comes in contact with the recording paper P, and the ink droplet I is transferred to the recording paper P, and the recording paper P is transported in the paper feeding direction (left side direction in FIG. 5). Accordingly, printing is performed on the recording paper P.

Figure 6:
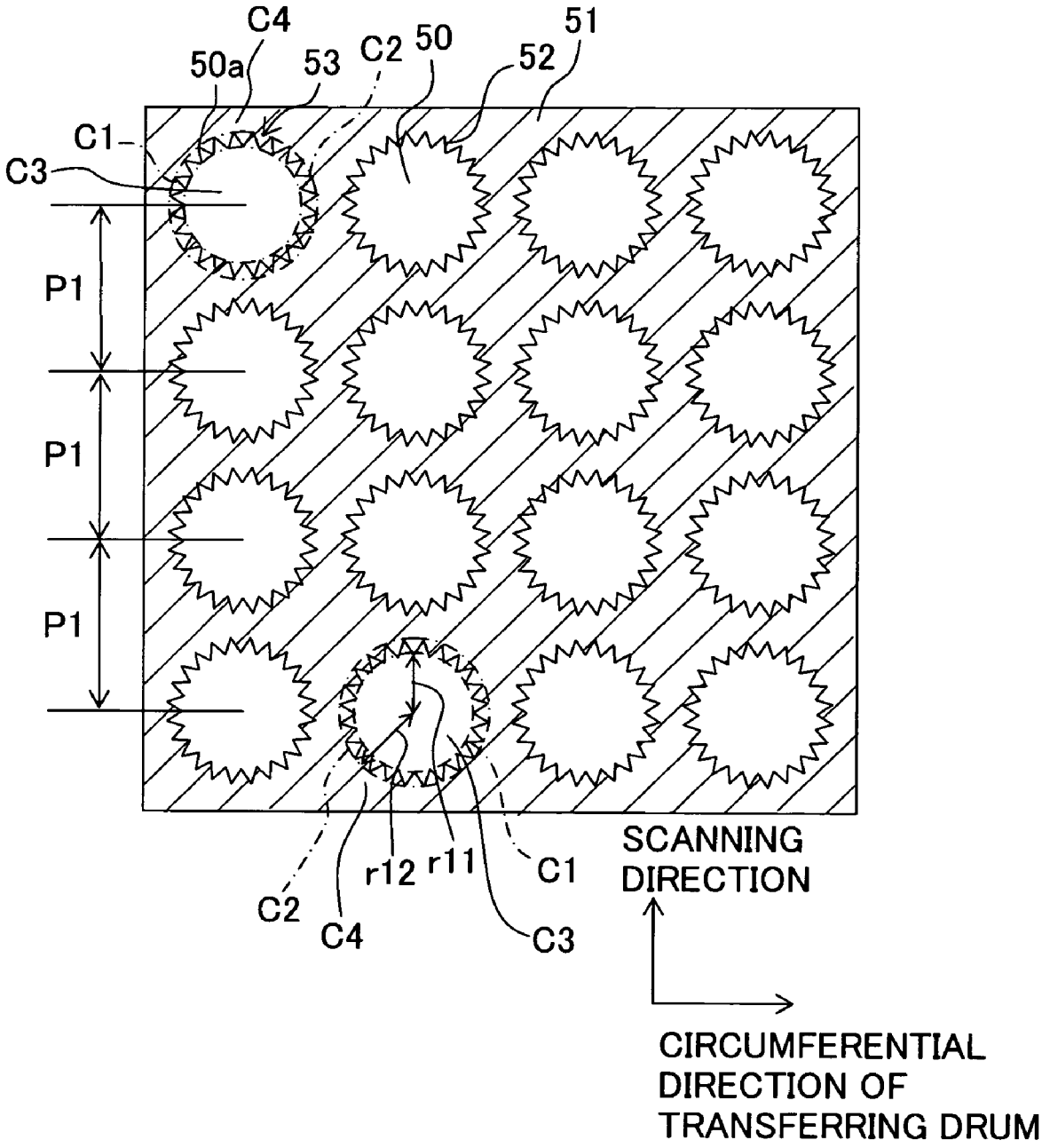
FIG. 6 is a plan view in which a part of a side surface of a transferring drum in FIG. 5 is enlarged.

As shown in FIG. 6, a plurality of lyophilic areas 50 and a liquid repellent area 51 surrounding the lyophilic areas 50, having a liquid repellent property higher than a liquid repellent property of the lyophilic areas 50 are formed on the side surface 3*a* of the transferring drum 3. In the present invention, the term "liquid repellent area" means an area in which a wetting angle with respect to the ink droplet is larger than a wetting angle in the lyophilic area. It is desirable that the wetting angle in the liquid repellent area is larger than that in the lyophilic area 50 by at least 10 degrees in order to make the ink droplet move smoothly toward the center of the lyophilic area 50. In this embodiment, it is allowable that the wetting angle of the liquid repellent area is not less than 60 degrees, and that the wetting angle of the lyophilic area is not more than 50 degrees. The lyophilic areas 50 are arranged at fixed intervals in the scanning direction (vertical direction in FIG. 6) and in a circumferential direction (left and right direction in FIG. 6) of the transferring drum 3. The interval (spacing distance) between the adjacent lyophilic areas 50, with respect to the scanning direction is P1 which is same as the spacing distance between the nozzles 15 (refer to FIG. 2) with respect to the scanning direction described earlier. Moreover, on the side surface 3*a*, the area surrounding the lyophilic areas 50 other than the portion in which the lyophilic areas 50 are formed are the liquid repellent area 51.

Moreover, the circumference (boundary line) 52 between the lyophilic area 50 and the liquid repellent area 51 is formed over the entire circumference of the lyophilic area 50, in a serrated form bent alternately at a fixed angle, on a circle C1 having a radius r11 making a center same as a center of the lyophilic area 50, and on a circle C2 which is concentric with the circle C1 and which has a radius r12 (>r11). An area in a form of a ring which is a circumferential area 53 between the lyophilic area 50 and the liquid repellent area 51, is defined by these circles C1 and C2. In other words, an inner side (first area) C3 of the circle C1 is an area which is formed by only the lyophilic area 50, and an outer side (second area) C4 of the circle C2 is an area which is formed by only the liquid repellent area 51, and the circumferential area 53 is an area (transition area) in which the lyophilic area 50 and the liquid repellent area 51 exist in a mixed manner. Consequently, an average liquid repellent property of the circumferential area 53 is higher than the liquid repellent property of the lyophilic area 50 and lower than the liquid repellent property of the liquid repellent area 51. Moreover, in the lyophilic area 50 in the circumferential area 53, a plurality of projections 50*a* in a form of an acute angle pointing toward an outer side of a radial direction of the circle C1, in other word toward the liquid repellent area 51, is formed in a pattern arranged at an equal interval over the entire circumference of the circle C1. Accordingly, in the circumferential area 53, a proportion of the liquid repellent area 51 with respect to an area of the lyophilic area 50 is increased progressively at positions away from the center of the lyophilic area 50, and the liquid repellent property is improved gradually, at positions away from the center of the lyophilic area 50. On the other hand, a volume of the ink droplet I which is jetted from the nozzle 15 is adjusted such that a radius of an area on the side surface 3*a* to which the ink droplet I is adhered (hereinafter, called as only "radius") is not less than r11, and not more than r12 when viewed from a direction orthogonal to the side surface 3*a*. Consequently, even when the ink droplet I jetted from the nozzle 15 is landed on the circumferential area 53, it is possible to move the ink droplet I toward the center of the lyophilic area 50 such that the center of the ink droplet I almost coincides with the center of the lyophilic area 50. Furthermore, in a case of performing a liquid droplet gradation, by adjusting the volume of the ink droplet I such that the radius is not less than r11 and not more than r12, a position shift in the final adhering position of the ink droplet I with respect to the side surface 3*a* of the transferring drum 3 does not occur, and it is possible to maintain a favorable printing quality. In the embodiment of the present invention, the radius of the small droplet I1 and the radius of the large droplet I3 (refer to FIG. 8) are r11 and r12 respectively, and the radius of the medium droplet I2 (refer to FIG. 8) is greater than the diameter r11 and smaller than the diameter r12. Here, for example, when a ratio of r11 and r12 is let to be 1:2, since a ratio of volumes becomes $1^3:2^3=1:8$, a liquid droplet gradation can be performed such that the ratio of the volume of the small droplet I1 with the volume of the large droplet I3 becomes 1:8.

For forming such lyophilic area 50 and the liquid repellent area 51, a liquid repellent film made of fluororesin is formed on the side surface 3*a* of the transferring drum 3. Moreover, a mask may be formed leaving a portion in which the lyophilic area 50 is formed on the side surface 3*a* of the transferring drum 3, and by irradiating an excimer laser or the like, the liquid repellent film on a portion in which the mask is not formed, may be removed. Accordingly, the portion from which the liquid repellent film is removed becomes the lyophilic area 50, and the portion on which the liquid repellent film is remained becomes the liquid repellent area 51.

Figure 7:
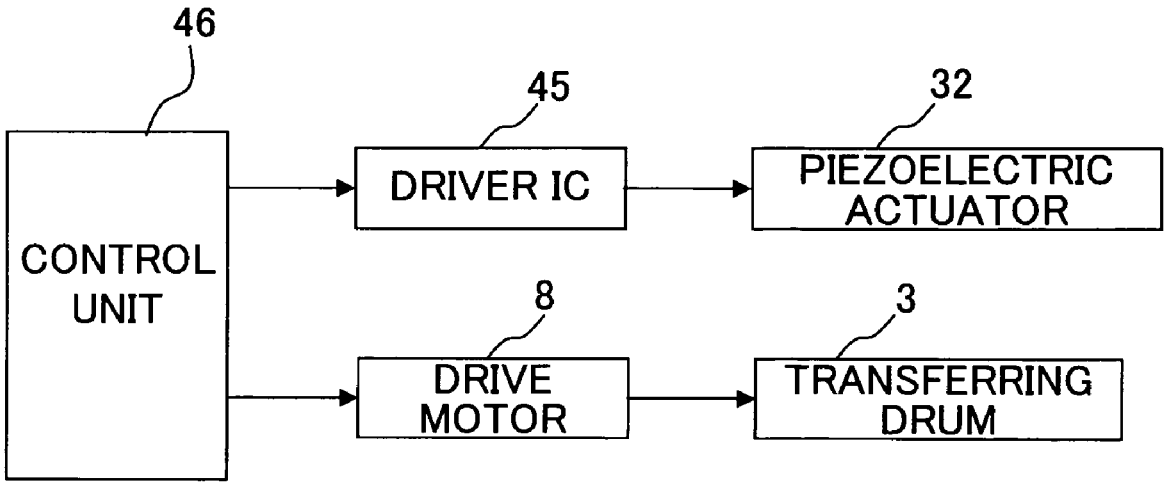
FIG. 7 is a block diagram showing a relationship of connection between a control unit, a driver IC, and a drive motor.

Here, an operation of the driver IC 45 which controls the piezoelectric actuator 32, and the drive motor 8 which rotates the transferring drum 3 is controlled by the control unit 46 as shown in FIG. 7. The control unit 46, at the time of performing printing, controls the operation of the driver IC 45 and the drive motor 8 such that an ink droplet is jetted from the nozzle 15 when a center of the lyophilic area 50 on the side surface 3*a* of the transferring drum 3 shown in FIG. 6 reaches an uppermost portion in FIG. 5. Accordingly, at least a part of the ink droplet jetted from the nozzle 15 is adhered to the corresponding lyophilic area 50.

Figure 8A:
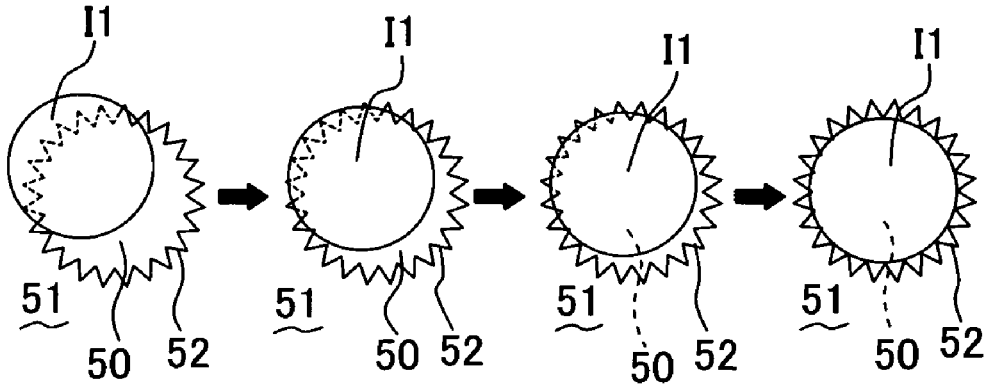
FIG. 8A, FIG. 8B, and FIG. 8C are diagrams showing a movement of an ink droplet which is adhered near a lyophilic area in FIG. 6, where

Next, a printing operation in the printer 1 will be described by referring to FIG. 5 to FIG. 8C. As shown in FIG. 8A, when the small droplet I1 jetted from the nozzle 15 is adhered spreading across the circumference (boundary line) 52 between the lyophilic area 50 and the liquid repellent area 51, in the circumferential area 53, the liquid repellent property of is declined progressively toward the center of the lyophilic area 50. Therefore, the small droplet I1 moves toward the center of the lyophilic area 50 which has low liquid repellent property. Finally, the small droplet I1 moves till a center of the small droplet I1 almost coincides with the center of the lyophilic area 50.

Figure 8B:
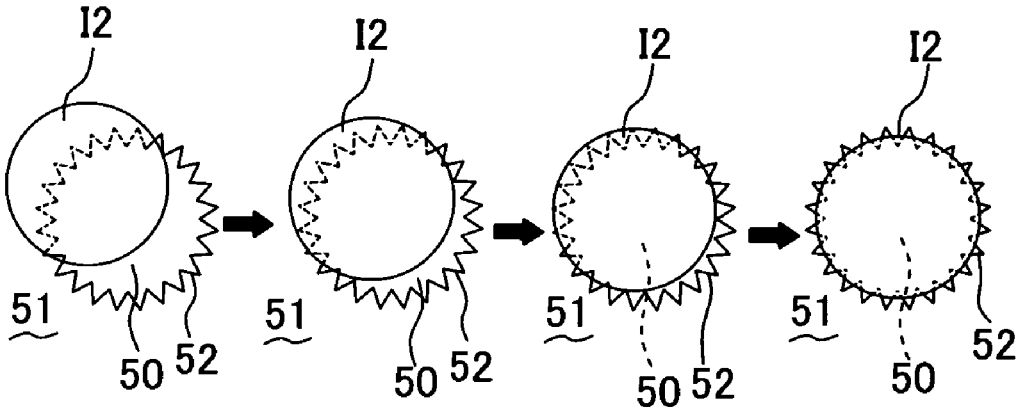
Figure 8C:
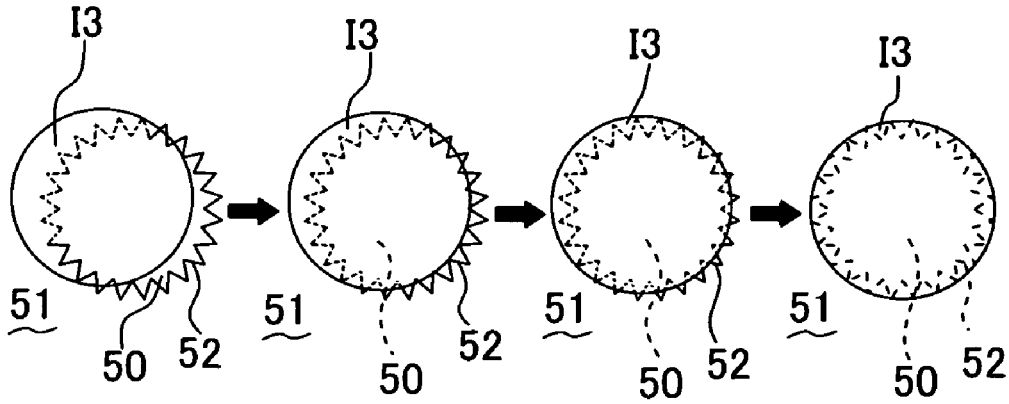

Similarly, as shown in FIG. 8B and FIG. 8C, even when the medium droplet I2 and the large droplet I3 are jetted from the nozzle 15, the medium droplet I2 and the large droplet I3 move toward the center of the lyophilic area 50 till the center of the medium droplet I2 and the center of the large droplet I3 almost coincide with the center of the lyophilic area 50.

The movement of the ink droplet mentioned above is completed in a time after the ink droplet is adhered to the side surface 3*a* of the transferring drum 3 till the ink droplet adhered to the side surface 3*a* is transferred to the recording paper P upon rotation of the transferring drum 3. Accordingly, the ink droplet is transferred to an appropriate position on the recording paper P, and the printing quality is improved.

According to the embodiment described above, the circumference (boundary line) 52 between the lyophilic area 50 and the liquid repellent area 51 is formed to be serrated, over the entire circumference of the lyophilic area 50 in the circumferential area 53. Consequently, the liquid repellent property on the circumferential area 53 between the lyophilic area 50 and the liquid repellent area 51 is gradually improved at positions away from the center of the lyophilic area 50. Therefore, even when the ink droplet I jetted from the nozzle 15, and having a size different from the size of the lyophilic area 50 is adhered spreading over the lyophilic area 50 and the liquid repellent area 51, due to a shift in a landing position on the side surface 3*a* of the transferring drum 3, it is possible to move the liquid droplet toward the center of the lyophilic area 50 having low liquid repellent property, till the center of the liquid droplet I almost coincides with the center of the lyophilic area 50. Accordingly, there is no position shift in a final adhering position of the ink droplet I on the side surface 3*a* of the transferring drum 3, and the ink droplet I is transferred to an appropriate position on the recording paper P. Therefore, the printing quality is improved.

Moreover, even when the three types of ink droplets (small droplet I1, medium droplet I2, and large droplet I3) of a mutually different volume are jetted from the nozzle 15, it is possible to move the ink droplet I which is adhered to the side surface 3*a* of the transferring drum 3, to the center of the lyophilic area 50. Therefore, even when the liquid droplet gradation is performed, there is no position shift in the final adhering position of the ink droplet I with respect to the side surface 3*a* of the transferring drum 3.

Moreover, the nozzles 15 are arranged at the interval P1 with respect to the scanning direction, and the lyophilic areas 50 are arranged at the interval P1 with respect to the scanning direction. Therefore, the ink droplet I jetted from the nozzle 15 is adhered to the corresponding lyophilic area 50, and the printing is performed assuredly.

Moreover, upon rotation of the transferring drum 3, when the lyophilic area 50 has reached a position facing the nozzle 15, the ink droplet I is jetted from the nozzle 15. Therefore, it is possible to make the ink droplet I adhere assuredly near the lyophilic area 50.

Next, modified embodiments in which various modifications are made in the embodiment will be described below. Same reference numerals are assigned to components which are similar as in the embodiment, and the description to be repeated is omitted.

Figure 9:
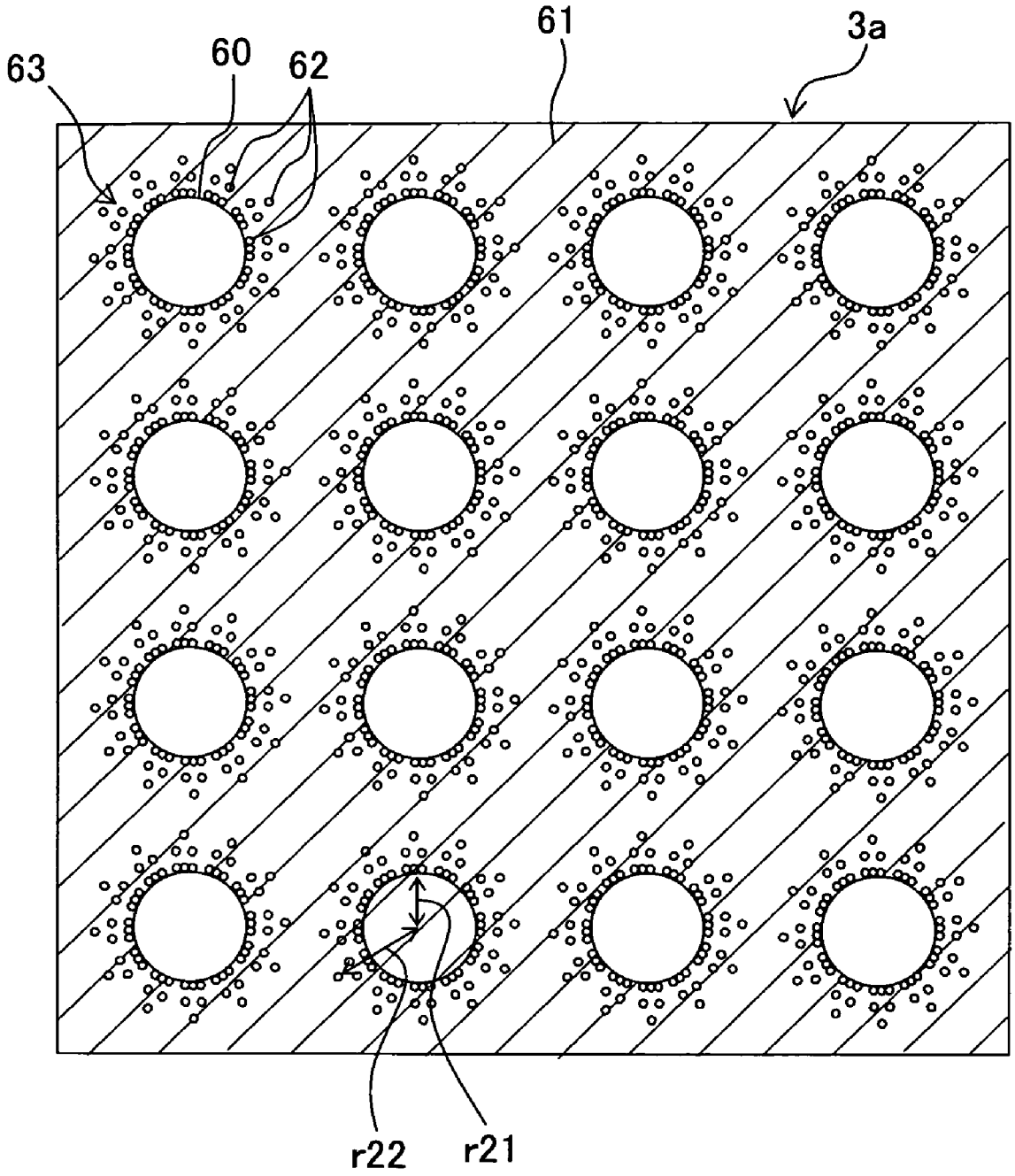
FIG. 9 is a plan view corresponding to FIG. 6, of a first modified embodiment.

As shown in FIG. 9, a circumferential area 63 between a liquid repellent area 61 and a lyophilic area 60, on the side surface 3*a* of the transferring drum 3 (refer to FIG. 5), may be formed by scattering in the liquid repellent area 61, a plurality of island portions 62 having a liquid repellent property almost same as a liquid repellent property of the lyophilic area. In this case, the island portions 62 may be arranged such that a distribution density of the island portions 62 decreases progressively at positions away from a center of the lyophilic area 60 (first modified embodiment). In this case also, in the circumferential area 63, an average liquid repellent property is higher than the liquid repellent property of the lyophilic area 60 and lower than the liquid repellent property of the liquid repellent area 61. Moreover, the liquid repellent property of the side surface 3*a* is improved progressively at positions away from the center of the lyophilic area 60. Therefore, when a radius of the ink droplet is not less than a radius r21 of the lyophilic area 60, and is not more than a distance r22 between the center of the lyophilic area 60 and an outermost portion of the island portion 62 arranged at an outermost side with respect to (of) the center of the lyophilic area, it is possible to move the ink droplet adhered to the side surface 3*a*, toward the center of the lyophilic area 60, till a center of the ink droplet almost coincides with the center of the lyophilic area 60. It is possible to form such island portions 62 also in a portion in which the island portions 62 are formed, by irradiating the excimer laser without forming the mask.

Figure 10:
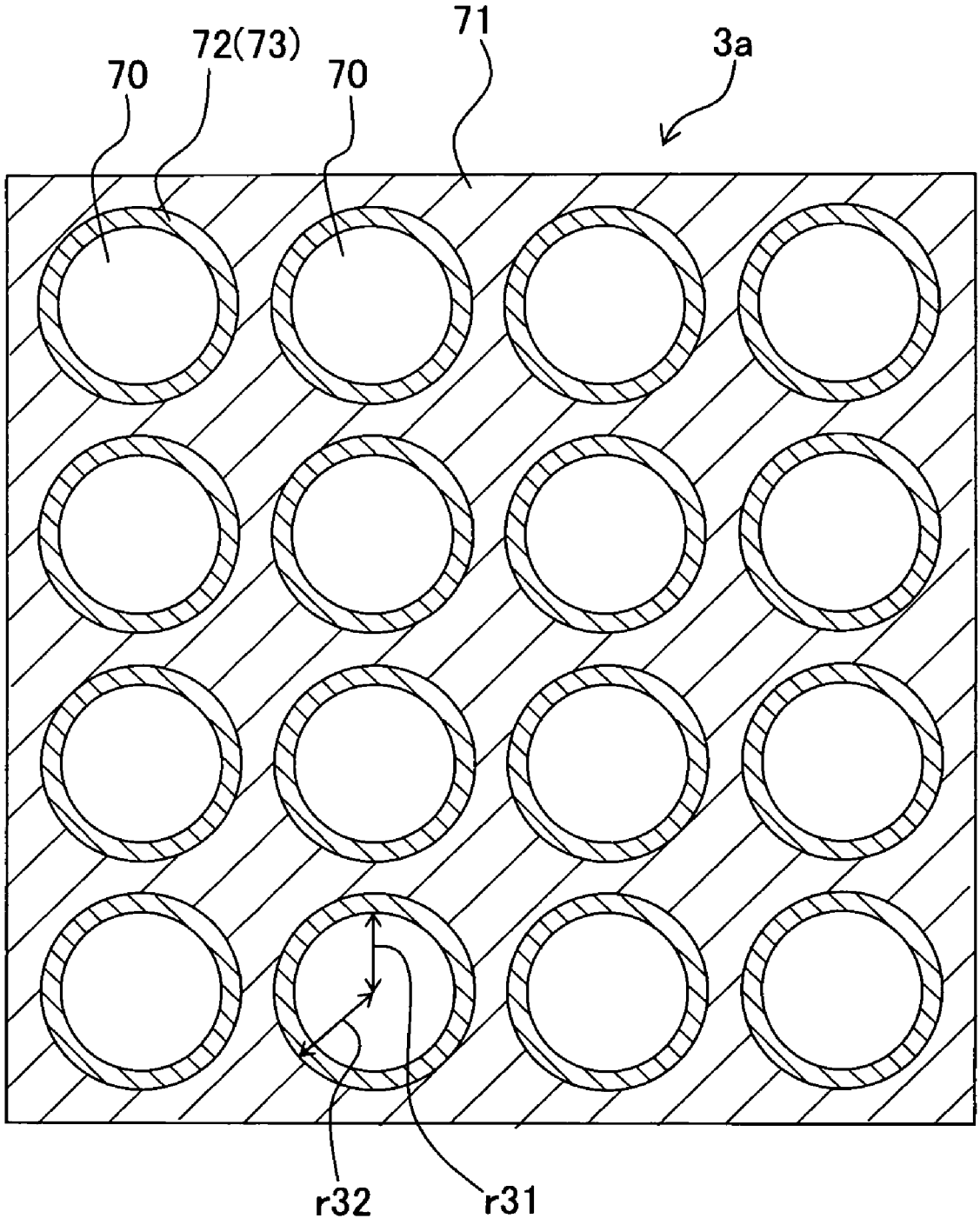
FIG. 10 is a plan view corresponding to FIG. 6, of a second modified embodiment.

As shown in FIG. 10, an intermediate area 72 having a liquid repellent property higher than a liquid repellent property of the lyophilic area 70, and lower than a liquid repellent property of the liquid repellent area 71, may be formed in a circumferential area 73 between the lyophilic area 70 and the liquid repellent area 71 (second modified embodiment). In this case, a circumferential area is formed by the intermediate area 72, and a part of the lyophilic area 70 and a part of the liquid repellent area 71 in continuity with the intermediate area 72, and an average liquid repellent property thereof is higher than the liquid repellent property of the lyophilic area 70 and lower than the liquid repellent property of the liquid repellent area 71. Even in this case, the liquid repellent property of the side surface 3*a* of the transferring drum 3 gradually increases at positions away from a center of the lyophilic area 70. Consequently, when the radius of the liquid droplet is not less than a radius r31 of the lyophilic area 70, and not more than a radius r32 of an outermost portion of the intermediate area 72, when the ink droplet is adhered spreading over the lyophilic area 70 and the liquid repellent area 71, it is possible to move the ink droplet toward a center of the lyophilic area 70, till the center of the liquid droplet almost coincides with the center of the lyophilic area 70. Such intermediate area 72, similarly as in the embodiment described above, can be formed as follows. First, after forming a mask in an area of the side surface 3*a* of the transferring drum 3, excluding the area in which the lyophilic area 70 is formed, the lyophilic area 70 is formed by irradiating the excimer laser. Next, after forming a mask in an area of the side surface 3*a*, excluding a portion in which the intermediate area 72 is formed, the intermediate area 72 is formed causing degradation of the liquid repellent film by irradiating the excimer laser. However, at the time of forming the intermediate area 72, it is necessary to make a time of irradiating the excimer laser shorter than a time of irradiation for forming the lyophilic area 70. Or, each of the lyophilic area 70, the circumferential area 73, and the liquid repellent area 71 may be formed of a different material. In this case, a polyimide film is formed on a side surface 3*a* made of aluminum alloy, of the transferring drum 3, and a liquid repellent film made of a fluororesin is formed further on the polyimide film. Next, a mask is formed on an area of the side surface 3*a*, excluding a portion on which the circumferential area 73 and the lyophilic area 70 are formed, and the fluororesin is removed by irradiating the excimer laser. Further, a mask is formed on an area of the side surface 3*a* excluding a portion on which the lyophilic area 70 is formed, and the polyimide film is removed by irradiating the excimer laser. Accordingly, a portion from which the liquid repellent film made of the polyimide film and the fluororesin film is removed, becomes the lyophilic area 70 formed of aluminum alloy, a portion from which the liquid repellent film made of the fluororesin is removed, becomes the circumferential area 73 formed of polyimide, and a portion on which the liquid repellent film of the fluororesin remains becomes the liquid repellent area 71. The lyophilic area 70 may be formed by coating an alumina layer on the side surface 3*a* of the transferring drum 3 made of aluminum alloy with sputtering or the like. The liquid repellent area 71 may be formed by coating a nickel layer containing particles of fluororesin with composite plating, or by coating a silicone resin layer.

Figure 11:
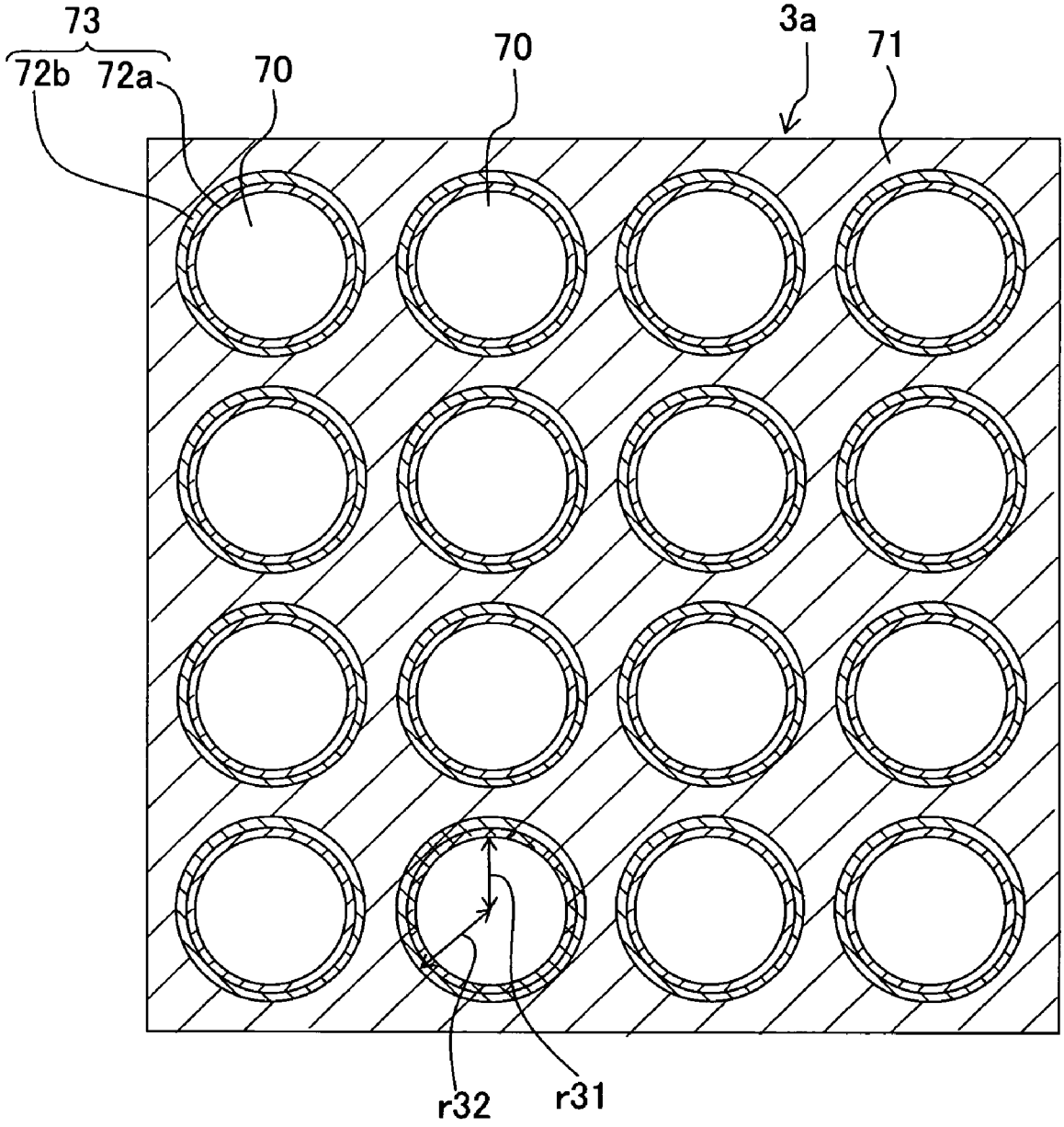
FIG. 11 is a plan view corresponding to FIG. 6, of a third modified embodiment.

Moreover, as shown in FIG. 11, in a circumferential area between a lyophilic area 70 and a liquid repellent area 71, a plurality (two in FIG. 11) of intermediate areas 82 and 83 may be formed in a radial direction of the lyophilic area 70. In this case, the intermediate area 83 which is provided on an outer side may have a liquid repellent property higher than a liquid repellent property of the intermediate area 82 which is provided on an inner side (the liquid repellent property of the plurality of intermediate areas may increase progressively at positions away from the center of the lyophilic area 70) (third modified embodiment). Even in this case, in the circumferential area, an average liquid repellent property thereof is higher than a liquid repellent property of the lyophilic area 80, and lower than a liquid repellent property of the liquid repellent area 81. Moreover, since the liquid repellent property of the side surface 3*a* of the transferring drum 3 gradually increases toward an outer side from the center of the lyophilic area 70, it is possible to move assuredly the ink adhered to the side surface 3*a* toward a central portion of the lyophilic area 80. The intermediate areas 82 and 83, similarly as in the second modified embodiment, are formed causing degradation of the liquid repellent film by irradiating the excimer laser. However, at the time of forming the outer side intermediate area 83, it is necessary to make a time of irradiating the excimer laser shorter than a time of irradiation for forming the inner side intermediate portion 82.

Figure 12:
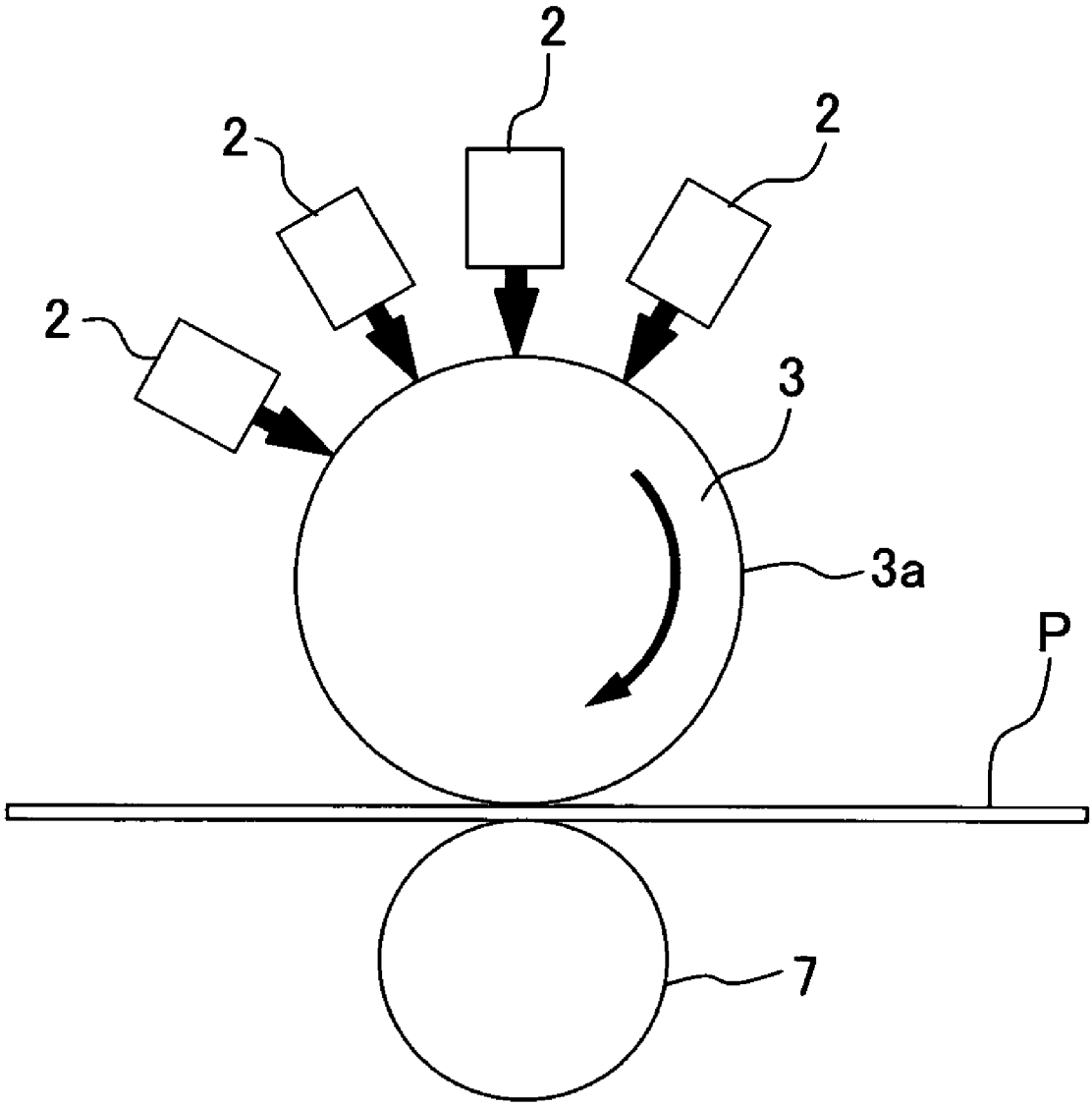
FIG. 12 is a cross-sectional view corresponding to FIG. 5, of a fourth modified embodiment.

As shown in FIG. 12, an arrangement may be made such that a plurality (four in FIG. 12) of ink-jet heads 2 is arranged in a direction of rotation of the transferring drum 3, and ink droplets of mutually different colors are jetted from the ink-jet heads 2 (fourth modified embodiment). In this case, the transferring drum 3 is rotated, and by jetting from the nozzle 15 when the lyophilic area 50 formed on the side surface 3*a* of the transferring drum 3 (refer to FIG. 6) reaches a position facing the nozzle 15 of each ink-jet head 2 (refer to FIG. 2), it is possible to perform printing of a plurality of colors (four colors in FIG. 12).

Figure 13:
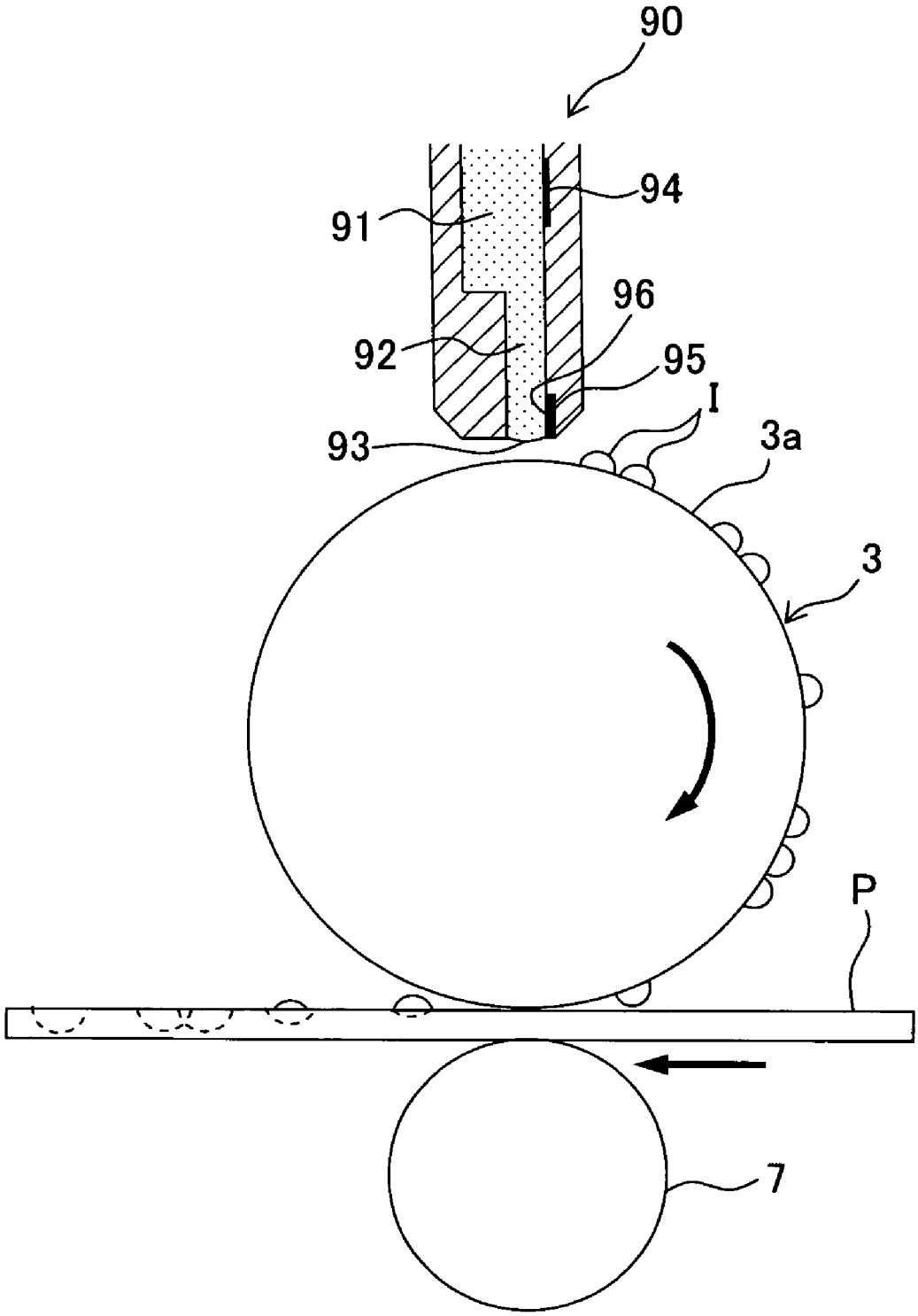
FIG. 13 is a cross-sectional view corresponding to FIG. 5 of a fifth modified embodiment.

A liquid droplet discharging section is not restricted to a liquid droplet discharging section of an ink-jet type. Instead of the ink-jet head 2, for example, an ink transporting head (liquid droplet discharging section) 90 in which a common electrode 94 is formed on a surface of a manifold channel 91, and an individual electrode 95 sandwiching a liquid repellent film 96 is formed on a surface near a discharge port 93 of an individual ink channel 92 which communicates with the manifold channel 91 may be arranged as shown in FIG. 13 (fifth modified embodiment). In this case, when the common electrode 94 and the individual electrode 95 are at the same electric potential (ground electric potential for example), since the liquid repellent film 96 exists, the ink is not flowed to a portion of the individual ink channel 92 on which the liquid repellent film 96 is formed, and the ink does not flow out from the discharge port 93. On the other hand, when there is an electric potential difference between the common electrode 94 and the individual electrode 95, since the liquid repellent property of the liquid repellent film is declined (electrowetting phenomenon: refer to Japanese Patent Application Laid-open No. 2003-177219), the ink also flows to a portion in which the liquid repellent film 96 is formed, and the ink flows out from the discharge port 93. Accordingly, it is possible to make the ink droplet adhere to the side surface 3*a* of the transferring drum 3 similarly as in the ink-jet head 2 in the embodiment.

Figure 14:
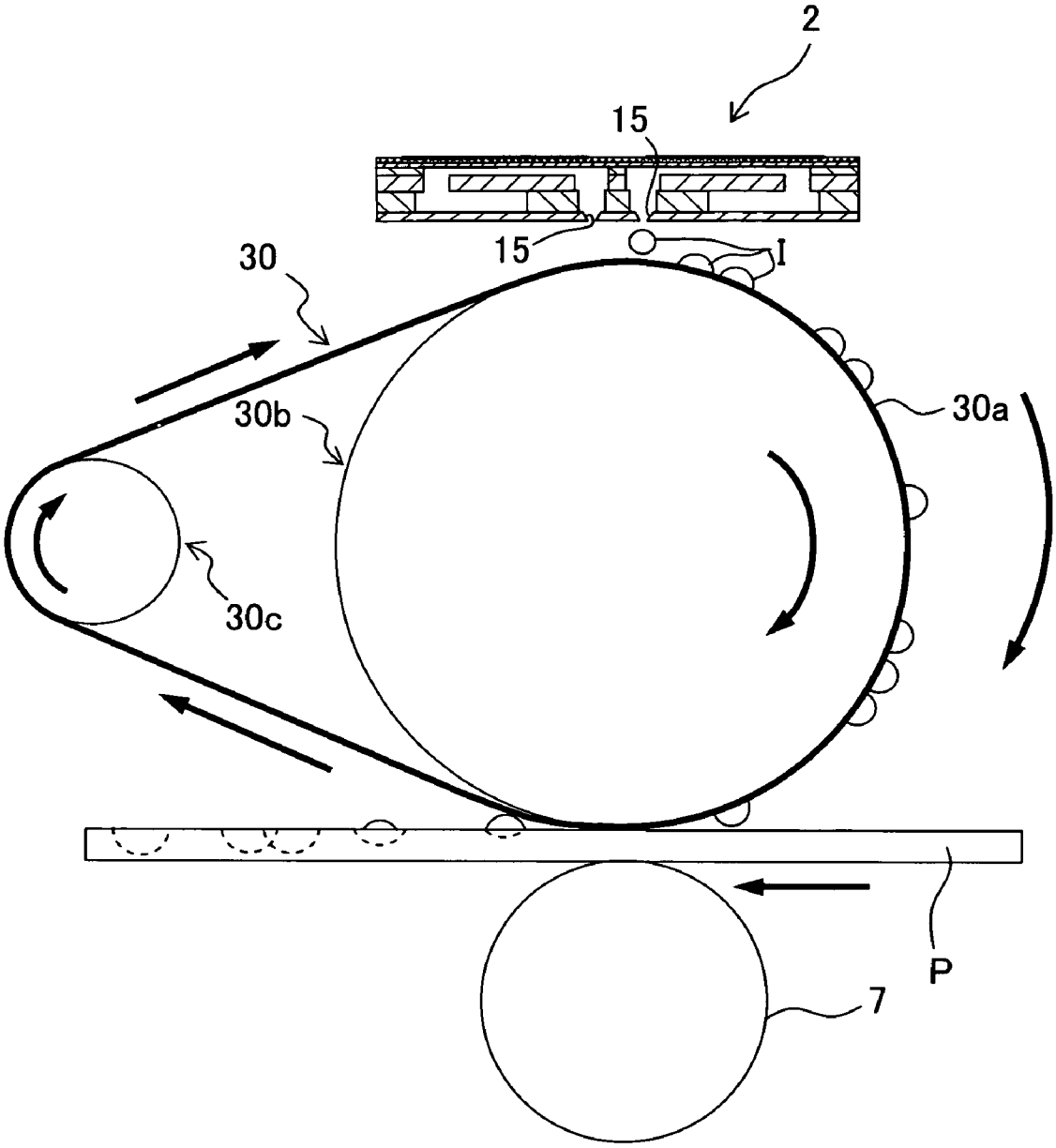
FIG. 14 is a cross-sectional view corresponding to FIG. 5 of a sixth modified embodiment.

Moreover, in the embodiment and the modified embodiments, although the transferring drum 3 is used as the transferring body, the transferring body is not restricted to the transferring drum 3. For example, as shown in FIG. 14, a belt 30 which is wound around a driving pulley 30*b* and a driven pulley 30*c* may be used as the transferring body. The driving pulley 30*b* is positioned under the ink-jet head 2, and is rotatable in a clockwise direction in FIG. 14. Moreover, the belt 30 faces the nozzle 15, at an uppermost portion of the driving pulley 30. The belt 30 put around the driving pulley 30*b* and the driven pulley 30*c* is rotated by the rotation of the driving pulley 30*b* which is rotated by the drive motor 8, and the belt performs a circumferential movement in the clockwise direction in FIG. 14. In this case, similarly as in the embodiment and the modified embodiments, a lyophilic area, a liquid repellent area, and a circumferential area are formed on a surface 30*a* of the belt 30. At the time of performing printing, by controlling the driver IC 45 and the drive motor 8 such that an ink droplet is jetted at a timing when a center of the lyophilic area formed on the surface 30*a* of the belt 30 reaches right under the nozzle 15, it is possible to achieve an effect similar to an effect in the embodiment and the modified embodiments. A direction of rotation of the driving pulley 30*b* and the belt 30 may be a counterclockwise direction in FIG. 14.

In the abovementioned description, the circumference (boundary line) between the lyophilic area and the liquid repellent area is formed to be circular shaped or serrated along the circle. However, the shape of the circumference is not restricted to this, and it may have other shape such as a triangular shape, a rectangular shape, and an elliptical shape.

Moreover, in the abovementioned description, an example in which the present invention is applied to a printer which performs printing by transferring the ink droplet to the recording paper, is shown. However, the present invention is also applicable to other printers which transfer a liquid other than the ink, to a printing medium. It is also possible to apply the present invention to a printer which forms a wiring pattern by transferring to a substrate, an electroconductive liquid in which metallic nano particles are dispersed, a printer which manufactures a DNA chip by using a solution in which DNA is dispersed, and a printer which manufactures a color filter for liquid crystal display by using a liquid in which pigments for the color filter are dispersed.

What is claimed is:

1. A printer which performs printing on a recording medium by discharging liquid droplets, comprising:

a liquid droplet discharging section which has a plurality of discharge ports; and a transferring body which transfers, to the recording medium, the liquid droplets discharged from the discharging ports, and which has on a surface thereof a plurality of lyophilic areas, a plurality of circumferential areas surrounding the lyophilic areas, and a liquid repellent area surrounding the circumferential areas;

wherein a liquid repellent property on the circumferential areas is progressively increased at positions away from a center of the lyophilic area.

2. The printer according to claim 1, wherein on each of the circumferential areas, a proportion of an area of the liquid repellent area with respect to an area of the lyophilic area, increases progressively at positions away from the center the lyophilic area.

3. The printer according to claim 2, wherein a boundary between each of the lyophilic areas and the liquid repellent area is serrated.

4. The printer according to claim 2, wherein in each of the circumferential areas, the lyophilic area forms a pattern in which a plurality of projections projected acutely toward the liquid repellent area are arranged.

5. The printer according to claim 2, wherein in each of the circumferential areas, a plurality of island portions having a liquid repellent property same as a liquid repellent property of the lyophilic area is arranged in a discrete manner in the liquid repellent area, and a distribution density of the island portions decreases progressively at positions away from the center of the lyophilic area.

6. The printer according to claim 1, wherein: in each of the circumferential areas, an intermediate area having a liquid repellent property which is higher than a liquid repellent property of one of the lyophilic areas, and is lower than a liquid repellent property of the liquid repellent area is provided along an entire circumference of one of the lyophilic areas.

7. The printer according to claim 6, wherein in each of the circumferential areas, the intermediate area is formed as a plurality of intermediate areas in a radial direction of one of the lyophilic areas; and a liquid repellent property of the intermediate areas increase progressively at positions away from the center of one of the lyophilic areas.

8. The printer according to claim 1, wherein the liquid droplet discharging section discharges liquid droplets of different volumes.

9. The printer according to claim 1, wherein:

in the liquid droplet discharging section, the discharge ports are arranged in a predetermined direction;

in the transferring body, the lyophilic areas are arranged in the predetermined direction; and a spacing distance between the discharge ports in the predetermined direction is same as a spacing distance between the lyophilic areas in the predetermined direction.

10. The printer according to claim 1, wherein:

the transferring body has a substantially circular cylindrical shape, and is rotatably attached to the printer about a predetermined axis as a center, and the lyophilic areas and the liquid repellent area are formed on a side surface of the transferring body; and the transferring body rotates about the predetermined axis as the center to discharge the ink droplets from the discharge ports when the lyophilic areas reach a position facing the discharge ports.

11. A transferring body which transfers, to a recording medium, a liquid droplet discharged from a liquid droplet discharging section, comprising:

a first area which is formed on a surface of the transferring body;

a transition area which is formed on the surface of the transferring body, and which surrounds the first area; and a second area which is formed on the surface of the transferring body, and which surrounds the transition area, wherein a liquid repellent property on the transition area is higher than a liquid repellent property of the first area, and is lower than a liquid repellent property of the second area.

12. The transferring body according to claim 11, wherein the liquid repellent property of the transition area increases progressively at positions away from a center of the first area.

13. The transferring body according to claim 11, wherein in the transition area, a lyophilic area and a liquid repellent area exist in a mixed manner.

14. The transferring body according to claim 13, wherein in the transition area, a proportion of an area of the liquid repellent area with respect to an area of the lyophilic area increases progressively at positions away from the center of the first area.

15. The transferring body according to claim 13, wherein in the transition area, a boundary between the lyophilic area and the liquid repellent area is formed to be serrated.

16. The transferring body according to claim 13, wherein in the transition area, the lyophilic area is formed along a circumference of the first area as a plurality of lyophilic areas projecting acutely toward the second area.

17. The transferring body according to claim 13, wherein in the transition area, the lyophilic areas are arranged in a discrete manner in the liquid repellent area; and a distribution density of the lyophilic areas decreases progressively at positions away from the center of the first area.

18. The transferring body according to claim 11, wherein the first area is formed of an aluminum alloy, the transition area is formed of a polyimide, and the second area is formed of a fluororesin.

19. A printer which performs printing on a recording medium by discharging liquid droplets, comprising:

a liquid droplet discharging section which has a plurality of discharge ports; and the transferring body as defined in claim 11.

20. The printer according to claim 19, wherein:

in the liquid droplet discharging section, the discharge ports are arranged in a predetermined direction;

in the transferring body, the first area is formed as a plurality of first areas and the first areas are arranged in the predetermined direction; and a spacing distance between the discharge ports in the predetermined direction is same as a spacing distance between the first areas in the predetermined direction.

* * * * *